US006501784B1

(12) United States Patent
Boehm et al.

(10) Patent No.: US 6,501,784 B1
(45) Date of Patent: Dec. 31, 2002

(54) THERMAL INSULATION TO BE INSERTED BETWEEN TWO INSULATING STRUCTURES

(75) Inventors: Alexander Boehm, Dresden; Clemens Korhammer, Bremen; Roland Scholl, Dresden; Bärbel Voigtsberger, Bad Klosterlausnitz; Lothar Schneider, Coswig; Günther Stephani, Grosserkmanndorf, all of (DE)

(73) Assignees: Fraunhofer-Gesellschaft zur Förderung der Angewandten Forschung e.V., Müchen (DE); Nabertherm GmbH & Co. Industrieofenbau KG, Lilienthal/Bremen (DE)

( * ) Notice: Subject to any disclaimer, the term of this patent is extended or adjusted under 35 U.S.C. 154(b) by 0 days.

(21) Appl. No.: 09/673,737

(22) PCT Filed: Apr. 20, 1999

(86) PCT No.: PCT/DE99/01186

§ 371 (c)(1),
(2), (4) Date: Mar. 22, 2001

(87) PCT Pub. No.: WO99/54655

PCT Pub. Date: Oct. 28, 1999

(30) Foreign Application Priority Data

Apr. 20, 1998 (DE) ..... 198 17 469

(51) Int. Cl.[7] ..... F27D 1/00

(52) U.S. Cl. ..... 373/137; 428/333; 373/71; 373/155

(58) Field of Search ..... 373/109, 118, 373/119, 137, 163, 164, 155, 156, 71, 72; 428/333, 406

(56) References Cited

U.S. PATENT DOCUMENTS

| | | | | |
|---|---|---|---|---|
| 3,769,770 A | | 11/1973 | Deschamps et al. | |
| 4,039,297 A | | 8/1977 | Takenaka | |
| 4,303,732 A | * | 12/1981 | Torobin | 428/333 |
| 4,357,375 A | | 11/1982 | Atkinson, Jr. | |
| 4,459,145 A | | 7/1984 | Elsholz | |
| 5,332,200 A | | 7/1994 | Gorin et al. | |
| 5,713,974 A | | 2/1998 | Martin et al. | |

FOREIGN PATENT DOCUMENTS

| | | |
|---|---|---|
| DE | 2034597 | 1/1972 |
| DE | 3011676 | 10/1980 |
| DE | 19519984 | 11/1986 |
| DE | 4418598 | 11/1996 |
| DE | 19509984 | 11/1996 |
| DE | 19603196 | 8/1997 |
| WO | 96/07538 | 3/1996 |

OTHER PUBLICATIONS

Japanese Patent Abstract of No. 01131083 A published May 23, 1989.

* cited by examiner

*Primary Examiner*—Tu Ba Hoang
(74) *Attorney, Agent, or Firm*—Greenblum & Bernstein, P.L.C.

(57) ABSTRACT

Disclosed is a thermal insulation to be inserted between two structures, surfaces, walls or the walls of components which are to be insulated. The thermal insulation consists of an plurality of hollow spheres made up by loose hollow spheres or by hollow spheres which are interconnected by sintered contacts. The ratio of the outer diameter of the hollow spheres to their wall thickness is 5 300. The hollow spheres are made of silicides, silicide composites, metals and intermetals and the alloys thereof, ceramics or glass. When the walls of the hollow spheres have a closed porous structure, the inner pressure in the hollow spheres is between 0 to 0.1 that of the surrounding air pressure at room temperature.

28 Claims, 9 Drawing Sheets

THERMAL INSULATION TO BE INSERTED BETWEEN TWO INSULATING STRUCTURES

CROSS-REFERENCE TO RELATED APPLICATIONS

The present application is a U.S. National Stage of International Application No. PCT/DE99/01 186 filed Apr. 20, 1999 and claims priority under 35 U.S.C. § 119 of German Patent Application No. 198 17 469.1 filed Apr. 20, 1998.

BACKGROUND OF THE INVENTION

1. Field of the Invention

The invention relates to a thermal insulation to be inserted between structures, surfaces, walls of components, and the like that are to be insulated.

2. Discussion of Background Information

In many technical application fields, the problem often exists that surfaces, components, or walls between which a temperature gradient is present must be insulated. This problem especially exists in heat treatment installation such as, for example in high-temperature furnaces. In high-temperature furnaces that are that are operated with air, fiber-like material is customarily used for thermal insulation. These materials have excellent thermal insulation properties, but have the disadvantage that very fine fiber components are released during use. Such fiber fragments have health-damaging effects and, as a result of fiber deposits on the annealing material, cause damage to the product. Besides thermal insulation in the construction of furnaces, such materials play a role in heat insulation of buildings. In further technical application fields, a highly effective thermal insulation can only be achieved with a high degree of expense in the area of production technology. This is based on the fact that a vacuum is commonly necessary between two surface structures to be insulated from one another.

SUMMARY OF THE INVENTION

It is the object of the present invention to provide a thermal insulation that has very good characteristics and, at the same time, can be produced in a technically simple and cost-effective manner.

Accordingly, the instant invention is directed to a thermal insulation that includes a fill of hollow spheres composed of hollow spheres that are loose or connected to one another by sintered contacts. Further, a ratio of an outer diameter of the hollow sphere to its wall thickness is within a range of 5–300 and the hollow spheres are made of suicides, silicide composites, metals, and intermetals and their alloys, ceramics, and glass. Moreover, in the case of a closed-pored structure of the walls of the hollow spheres, an internal pressure in the hollow sphere reaches a value that ranges between 0 and 0.1 of the surrounding air pressure at room temperature.

The solution recommended provides that silicides, silicide composites, metals and intermetals and their alloys, ceramic, and glass are used in the form of hollow spheres. Here, it is essential for the ratio of the diameter of the hollow sphere to its wall strength to lie between 5 and 300. The hollow spheres are inserted between the two surfaces, either by being poured loosely or connected to one another by means of sintered contacts. At the same time, these surfaces or strictures to be insulated from one another provide the limiting surfaces of the thermal insulation. The hollow spheres have the advantage that a smaller density of insulation is achieved, lying between 0.1 and 1.5 g/cm$^3$. In using gas-impermeable hollow spheres, with which the ratio between the interior pressure and the outer air pressure at room temperature lies between 0 to 0.1, the convection, i.e., the transfer of heat by way of gas movement, is drastically reduced. Due to the use of suicides and silicide composites as the primary material for such hollow spheres, the possibility is created in the field of high-temperature furnaces of producing a fiber-free insulation material that can be used in air at its temperature of use up to approximately 1800° C. For reasons of cost and in the case of low temperatures of use, metals, alloys, glasses and ceramics are used.

Particularly high temperature gradients arise between the interior chamber and the housing of a heat treatment furnace. The thermal insulation consisting of hollow spheres is particularly well-suited for use in such furnaces. It is particularly advantageous for the lining of the interior chamber of the furnace to consist of the same material as the hollow spheres. Certain types of heat treatment furnaces are provided with radiation shielding plates for the purpose of thermal insulation. By filling the present intermediate chambers between the plates with hollow spheres of the same material, an improvement of the heat insulation is achieved.

A further improvement of the insulation characteristics is achieved in that the surfaces of the radiation shielding plates and the hollow spheres are provided with reflection-altering coatings. Due to the coefficients of expansion of the basic material and of the reflection layer, which often do not correspond to one another, an expansion-adaptive intermediate layer is provided that, at the same time, can act as an oxygen diffusion layer. The intermediate layers are adapted in their characteristics to the material characteristics of the hollow spheres and the outer reflection-altering layer. For example, in the case of a ZrO2 outer layer, it consists of a metal-chromium-aluminum-yttrium compound. This intermediate layer prevents further oxidation of the basic material.

Especially in high-temperature furnaces and in the case of possible interactions of the materials with the atmosphere, it is possible to eliminate damages to the materia using certain ceramic housings.

The hollow spheres made of suicides and silicide composites as well as of ceramic can be produced by means of powder technology methods. Metallic hollow spheres can be produced by powder metallurgy means or usin galvanic processes.

Radiation shielding plates can be produced using powder technology methods (silicides, silicide composites) as well as using casting or deformation metallurgical methods (metals). A particular possibility for producing radiation shielding plates as thin-walled plates is film casting with subsequent separation and sintering. Metal powder spraying and extruding may also be used.

Typical wall thicknesses for hollow spheres and radiation shielding plates lie between 10 and 5000 $\mu$m. Wall thicknesses of 50 to 100 $\mu$m have been shown to be particularly advantageous.

The use of suicides and silicide composites is particularly advantageous in the production of hollow spheres that are used in an air atmosphere in high-temperature furnaces. At high temperatures and in air atmospheres, silicide and silicide composites form, which prevent a gradual oxidation in the interior of the spheres. If metallic hollow spheres and metallic radiation shields are used that are operated in an oxidative atmosphere, coatings made of oxidation-resistant suicide layers are provided. They may be constructed in a graduated manner for the purpose of functional adaptation. This is particularly the case when, on the one hand, the adaptation of the coefficient of expansion to the basic material and, on the other hand, the adaptation to the chemical reactivity of the surroundings are to be achieved.

Instead of silicide layers, high-melting glasses can be directly used that consist of high-melting oxides such as Y2O3, ZrO2, HFO2, and the like alone or in a mixture with SiO2.

Layers made of high-melting glasses are also provided in the case of thin-walled silicide hollow spheres since, by themselves, they do not form a sufficiently thick glass layer at high temperatures and in an air atmosphere.

The following processes for the production of functional coatings of the hollow spheres and radiation shielding plates have proven to be advantageous: slip casting, dipping in slips or sinters, thermal spraying processes, as well as wet powder sprays.

The hollow spheres can be connected to form semi-finished products in the form of plate-like components by means of sintering. Furthermore, it is advantageous to connect the piles of spheres directly to radiation shielding plates.

The invention shall be described in greater detail with reference to the following examples.

EXAMPLE 1

Mo and Si powder are ground into a finely dispersed composite powder in a high-energy mill, with the elements Mo and Si preferably being distributed in a laminar manner and the distance between lamellas being some 10 nm (DE 44 18 598). In this powder, which consists of agglomerates having a diameter of some $\mu$m, SiC powder (particle size approx. 1 to 10 $\mu$m) is added and mixed into the agglomerates until a homogeneous distribution is achieved. Plates with a thickness of approx. 1 mm are produced from the Mo, Si, and SiC mixture by means of pressing and sintering. The assembly of the radiation shielding plates occurs in correspondence with the construction according to FIG. 2, in which further necessary construction components (rods, pins, wedges, etc.) are produced from the same material, i.e., from the same initial powder, by means of pressing, sintering, and final production. Styrofoam spheres are coated with a suspension, also made of the same initial powders, by means of wet powder vortex layer processes, which suspension consists of the above-mentioned basic powder, an organic solvent bonding agents. After drying, the spheres that have been thus produced are separated by means of a sufficiently slow heating (2 K/min) to 1000° C. in an Ar-hydrogen mixture (6.5 vol.% hydrogen). After this, the heating (10 K/min) to 1600° C. occurs in a vacuum. After a holding time of 60 min., hollow spheres with a wall thickness of 200 $\mu$m are present. These spheres are poured between the radiation shielding plates described above.

EXAMPLE 2

Using fine, sinterable powders (approx. 10 $\mu$m) of a Cr—Ni alloy with poor heat conductivity, the method of production of raw hollow spheres described in example 1 is used by coating of styrofoam spheres with a metal powder binding agent suspension. After drying, the components are separated in an argon-hydrogen atmosphere in the manner described above and subsequently sintered at 1270° C. in high-vacuum until a closed-pore wall structure is present and thus gas-impermeable hollow spheres have been produced. After these hollow spheres are mixed with other hollow spheres of an appropriate diameter that allow a maximal filling of space, this mixture is placed between the inner and outer wall of an insulating jug. In this manner, it is possible to achieve a vacuum insulation as a thermal insulation without the conventional fragile glass bulbs being used.

BRIEF DESCRIPTION OF THE DRAWINGS

An exemplary embodiment is depicted in the following figures.

DETAILED DESCRIPTION OF THE INVENTION

Figure 1:
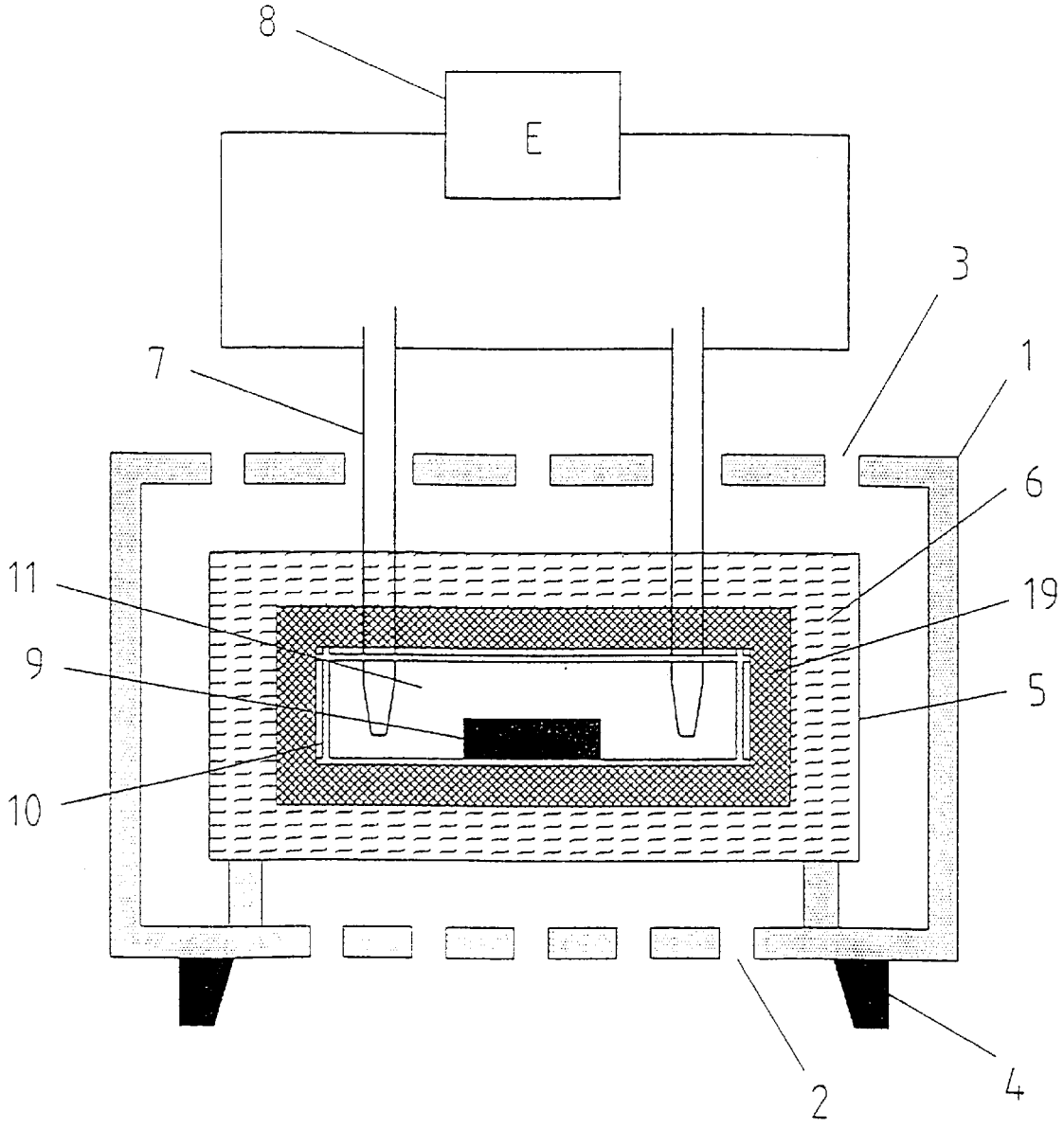
FIG. 1 High-temperature muffle furnace fitted with Mo-suicide radiation shielding plates.

In FIG. 1, a high-temperature muffle furnace is shown that uses air as its process gas. The furnace has a housing 1 that is provided with ventilation slits 2 and 3 for the purpose of convection cooling. The furnace stands on feet 4 that allow an entrance of air from below. The thermal insulation occurs by means of fiber mats 19 in the outer region of the muffle 11 and by means of ceramic lightweight bricks 6 that make up the muffle 11. The furnace is electrically heated by a heater 7 regulation and supply occur by means of an electric supply 8. The plate casing 5 ensures a reduction in loose fibers caused by the convection air between the housing 1 and the plate casing 5. The interior muffle 11 is fitted with a silicide shielding plate 10. During operation of the installation, it has now been prevented that, in the case of rapid temperature changes or in other processes, particles will be discharged and fall onto the annealing material 9 and damage it.

Figure 2:
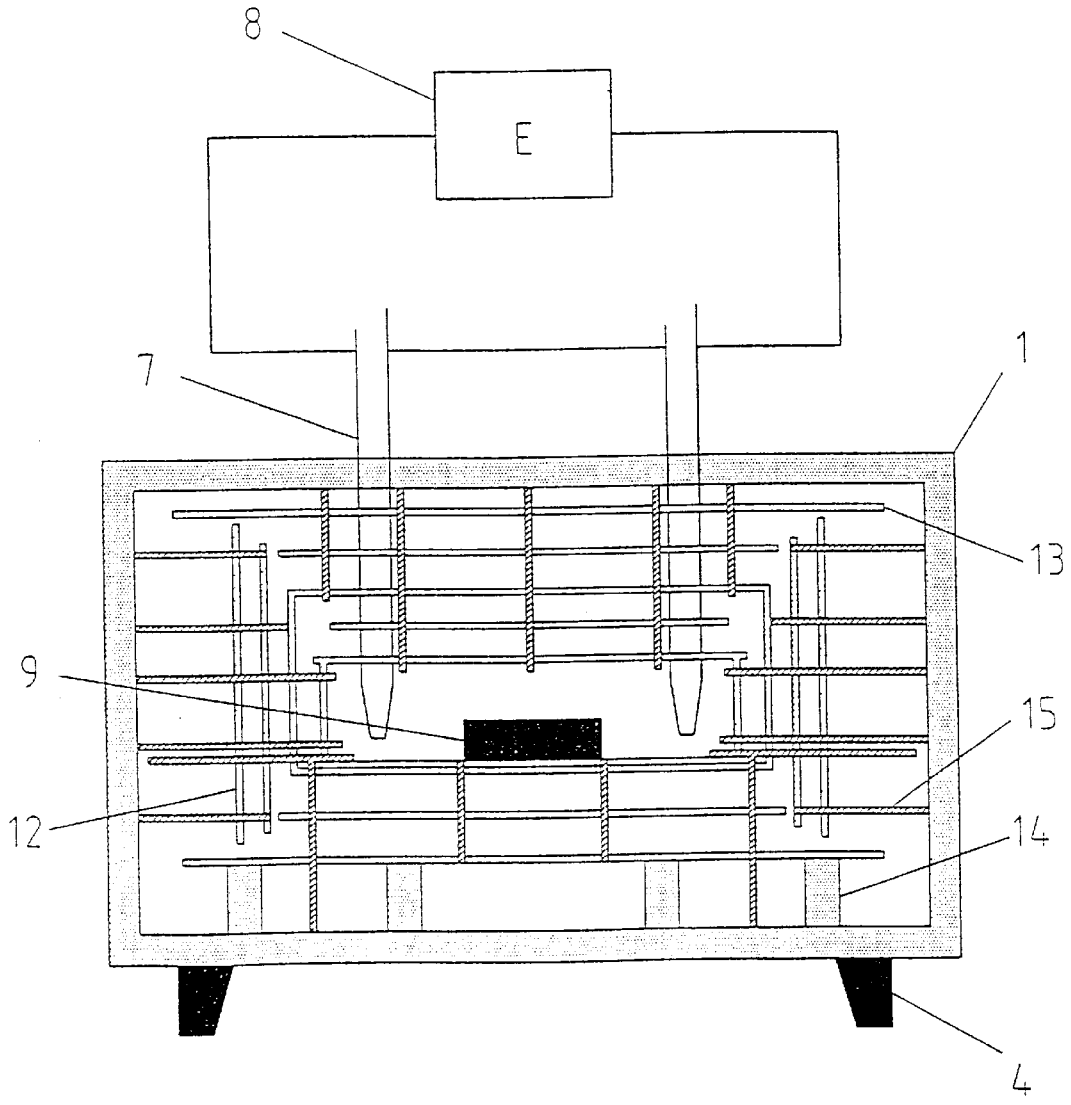
FIG. 2 High-temperature air furnace insulated with radiation shielding plates with Mo-suicide composites.

In FIG. 2, a high-temperature furnace is shown in which the thermal insulation has radiation shielding plates 12, 13 of different sizes. The support rods 14, 15 for the radiation shielding plates 12, 13 are also made of the suicide composite. By the arrangement of the radiation shield 12, 13, it is achieved that the heat radiation does not come directly into contact with the housing 1, but rather several layers of radiation shielding pates ensure that a lower degree of heating of the housing 1 occurs and thus a highly effective thermal insulation is achieved.

Figure 3:
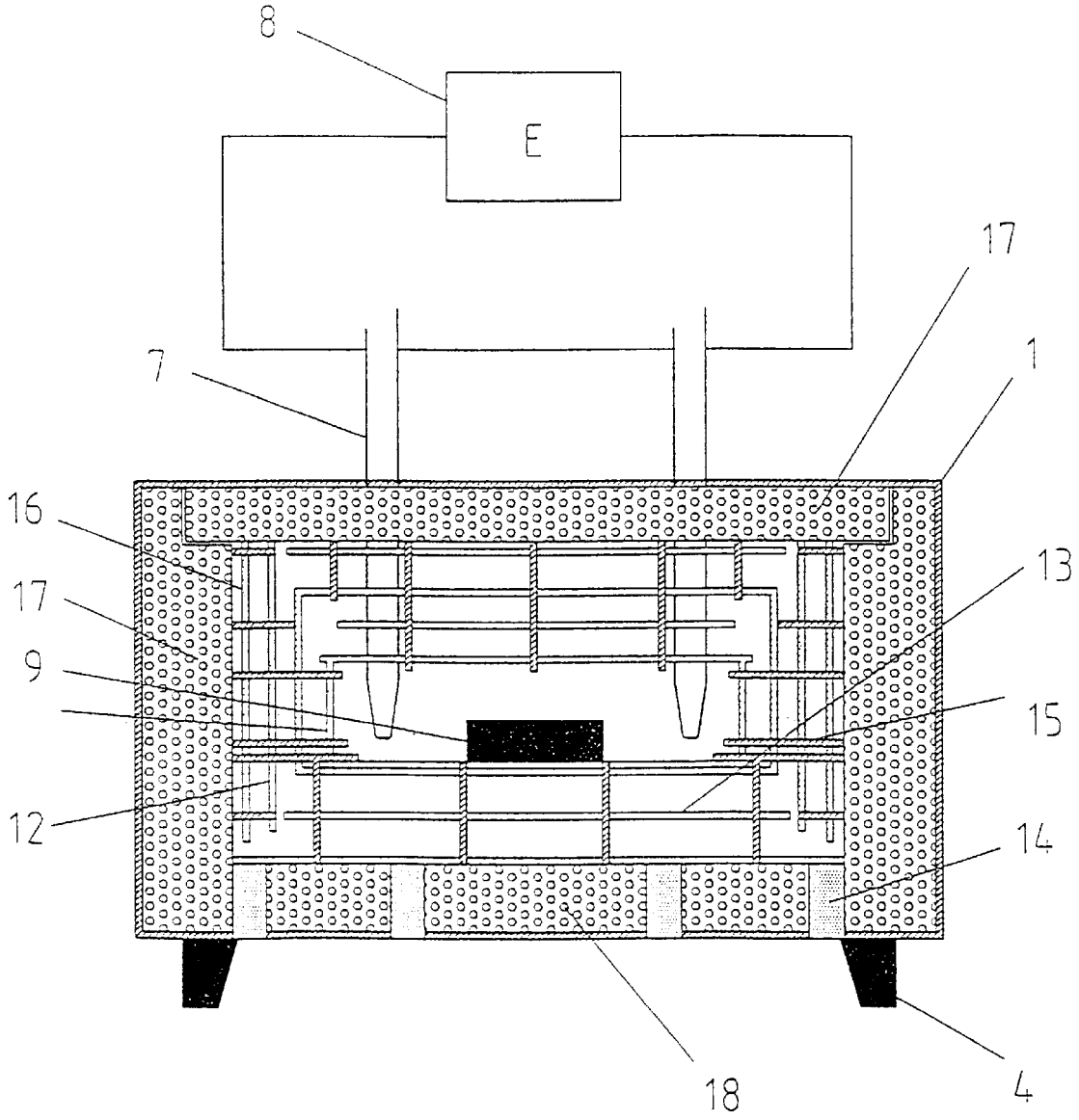
FIG. 3 High-temperature air furnace insulated with radiation shielding plates and hollow sphere semi-finished products made of Mo-silicide composites.

The furnace shown in FIG. 3 corresponds to the furnace shown in FIG. 2 in its basic construction. The space between the outermost radiation shielding plate 16 and the housing 1 is filled with a fill 17 of hollow spheres 18 made of a silicide material. In this case, the fill is shown in the form of semi-finished products 17 as plate-shaped components. By means of the semi-finished products 17, it is achieved that the outer region of the furnace is insulated in a manner similar to that of a vacuum furnace because the hollow spheres 18 comprise the largest portion of the volume and have been evacuated in their interior. This additional thermal insulation ensures that the heat transfer outwards is drastically reduced.

Figure 4:
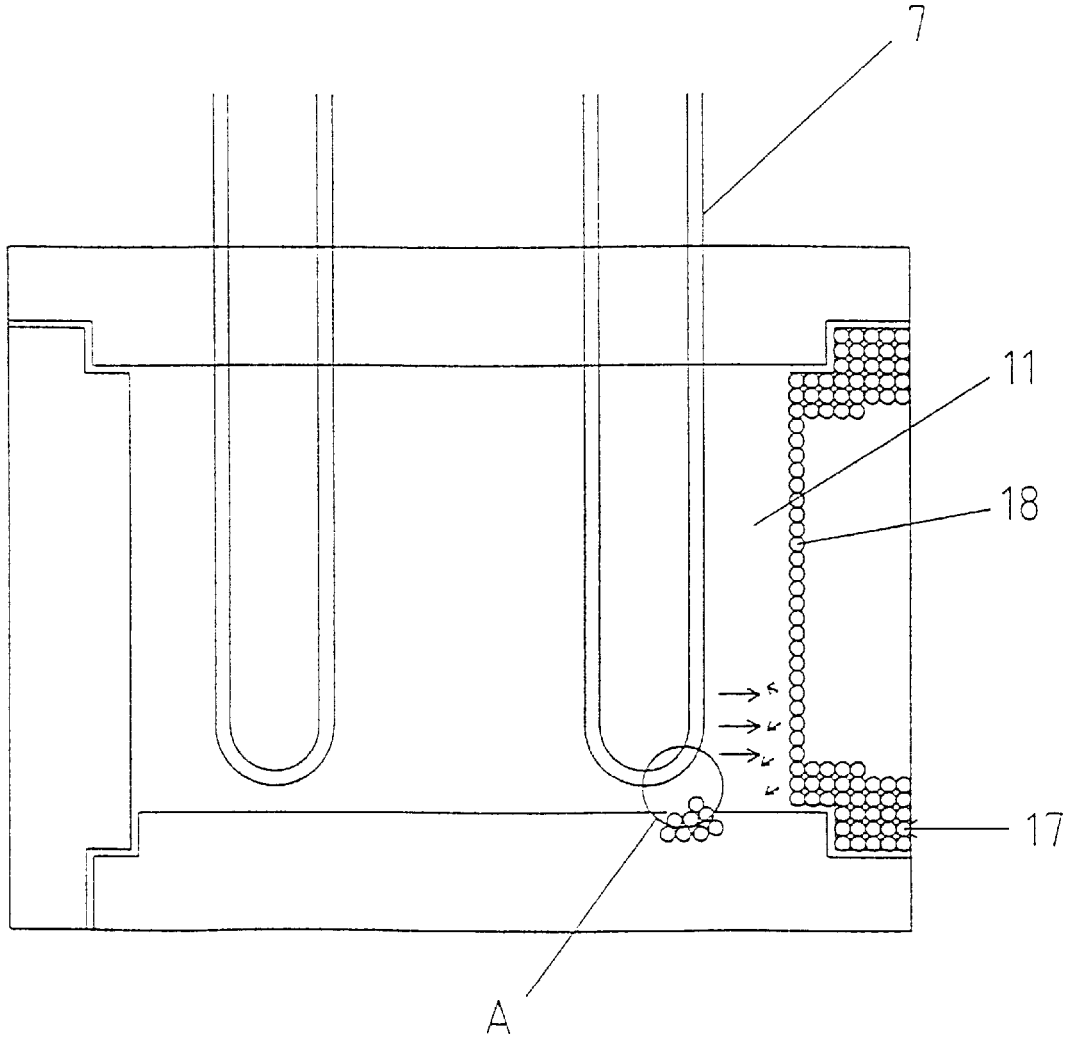
FIG. 4 A depiction of the principle of the radiation shielding for uncoated hollow spheres.

In FIG. 4, a high-temperature furnace is shown schematically. It has a heating element 7 and a hollow sphere fill as semi-finished products 17. This figure shows the radiation conditions in the muffle 11, in particular the radiation from the heater 7 occurring on the hollow sphere fill 17, which is slightly reflected to the hollow sphere surfaces 18. The degree of the reflection depends substantially on the surface quality of the hollow sphere 18.

Figure 5:
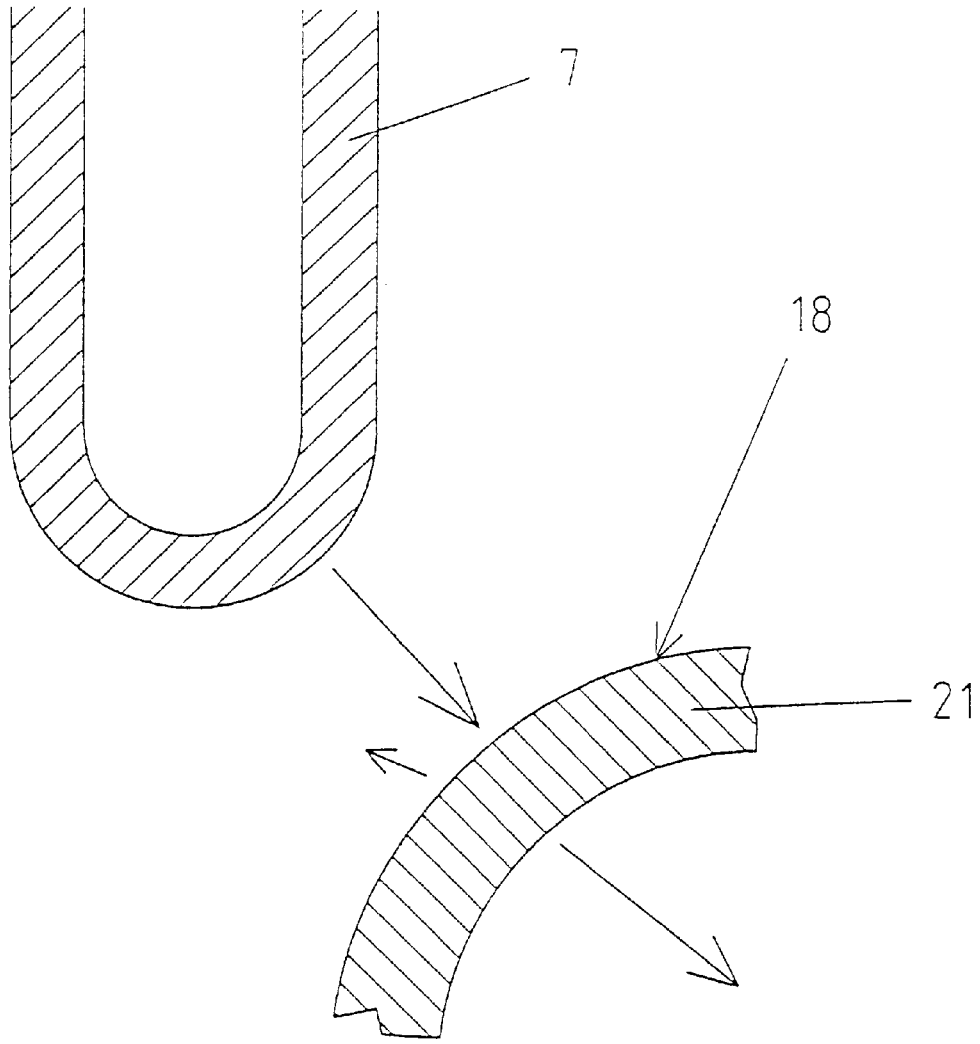
FIG. 5 Detail "A" of FIG. 4.

In FIG. 5, the radiation conditions between the heater surface with respect to the hollow sphere surface are shown. The radiation originating from the heater 7 and occurring on the hollow sphere 18 is only reflected in a fractional amount because the degree of reflection of the material used is low. A stream of heat presses through the wall 21 of the hollow sphere 18, which causes a radiation field towards the interior side of the sphere.

Figure 6:
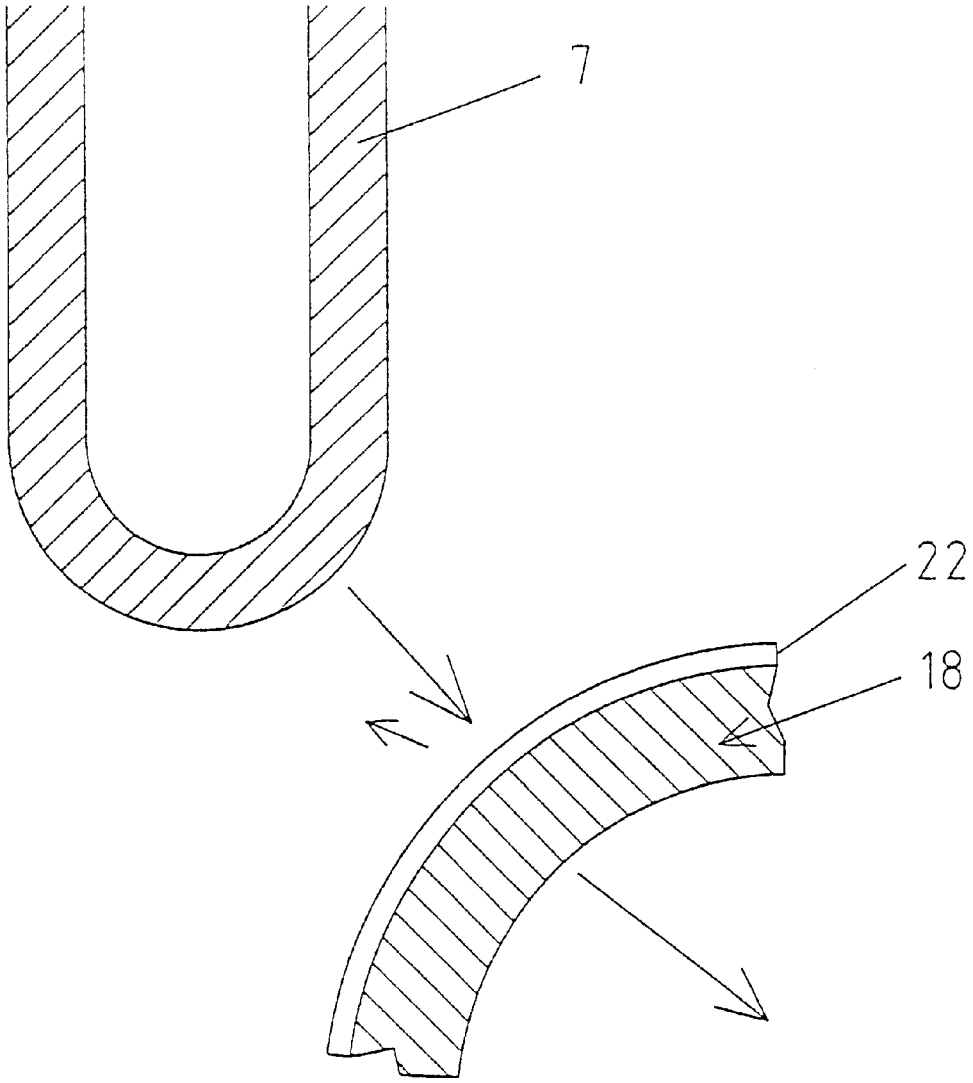
FIG. 6 Detail "A" of FIG. 4 in which the hollow sphere is coated.

From FIG. 6, it can clearly be seen that even a glass oxide layer 22 hardly effects the reflected radiation so that the same radiation can be detected on the interior side of the hollow sphere 18.

Figure 7:
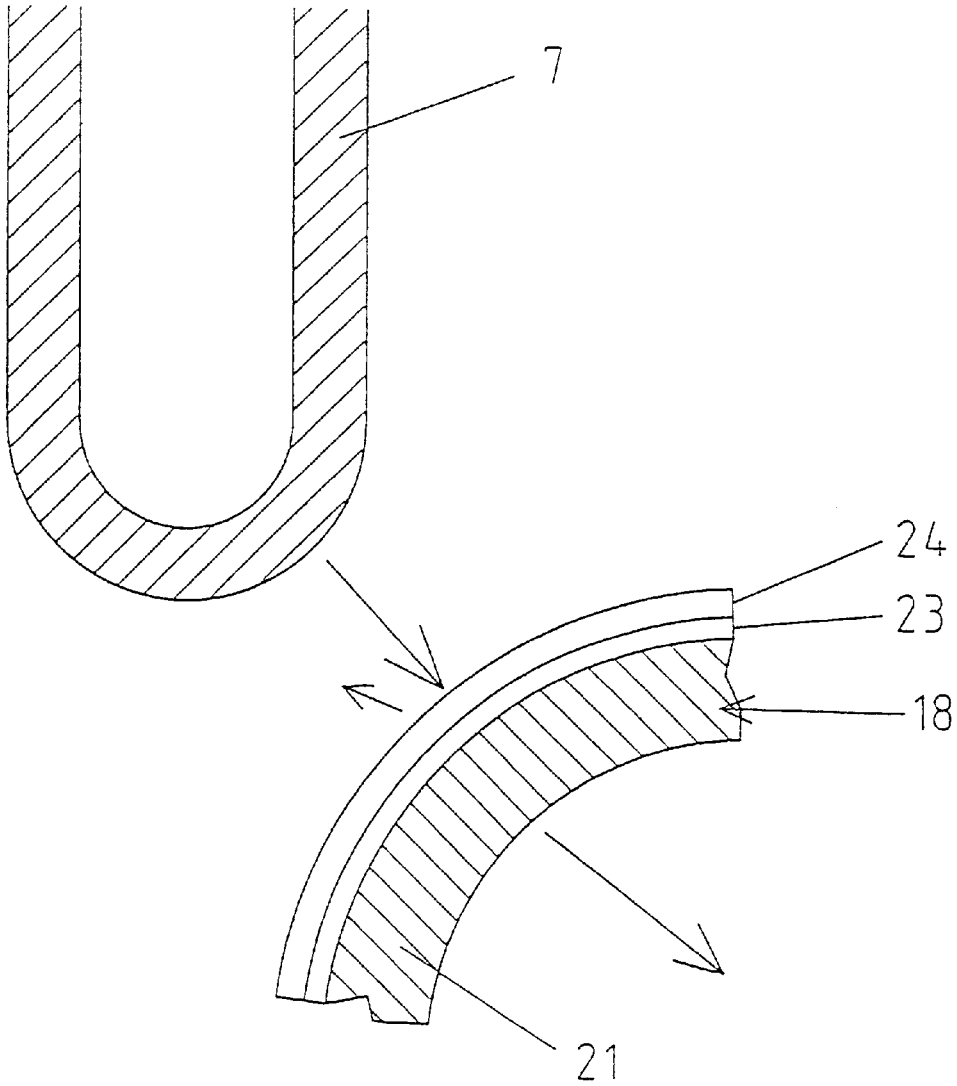
FIG. 7 Detail "A" of FIG. 4 in which the hollow sphere is coated with one reflective and one adhesive layer.

According to the depiction in FIG. 7, the wall 21 of the hollow sphere 18 has two functional layers 23, 24. The layer 24 has a high degree of reflection, which causes the radiation emanating from the heater 7 to be reflected to approx. 50 percent. The portion reflected on the interior side of the hollow sphere 18 is accordingly also approx. 50 percent. In particular, this layer is of ZrO2, a material that, besides a high degree of reflection, has a low thermal conductivity. Since the coefficient of expansion of the materials used for the hollow sphere 18 and the outer layer 24 are very different, an intermediate layer 23 is necessary that will compensate for these differences as an expansion-adaptive layer. Furthermore, the intermediate layer 23 prevents oxygen from penetrating up to the hollow sphere 18. A metal—Al—Cr—Y alloy is provided as a material for the layer 24.

Figure 8:
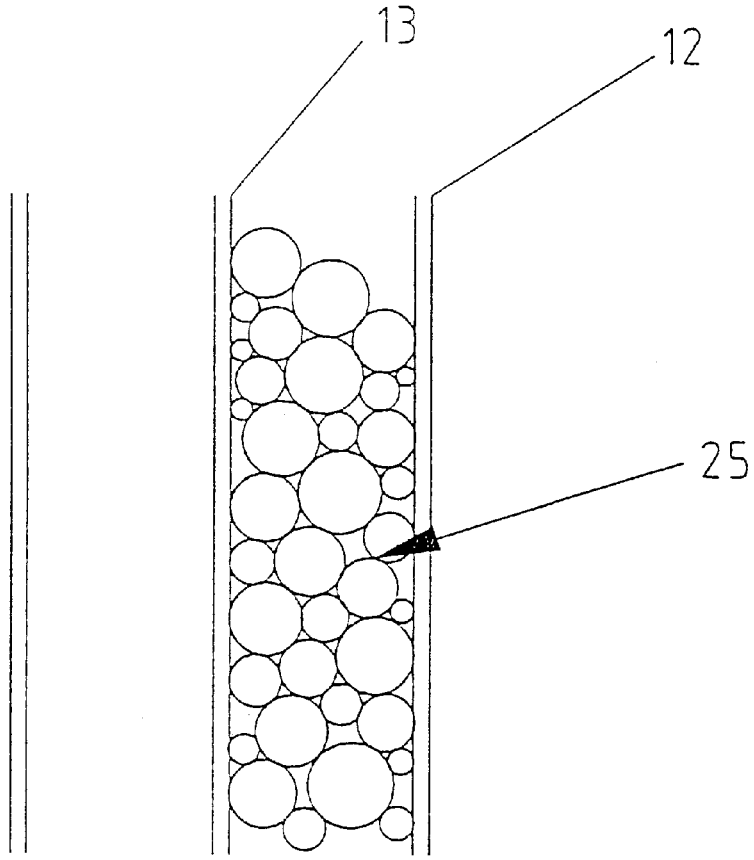
FIG. 8 Arrangement of silicide hollow spheres and silicide shielding plates as a thermal insulation.

In FIG. 8, radiation shielding plates 12, 13 and a hollow sphere fill located therebetween are shown. This arrangement connects the shielding of the heat radiation, on the one hand, and decreases the portion of convection at the heat transfer by way of the hollow sphere fill 25, on the other hand.

FIGS. 4 to 8 show embodiments of the thermal insulation of high-temperature furnaces.

Figure 9:
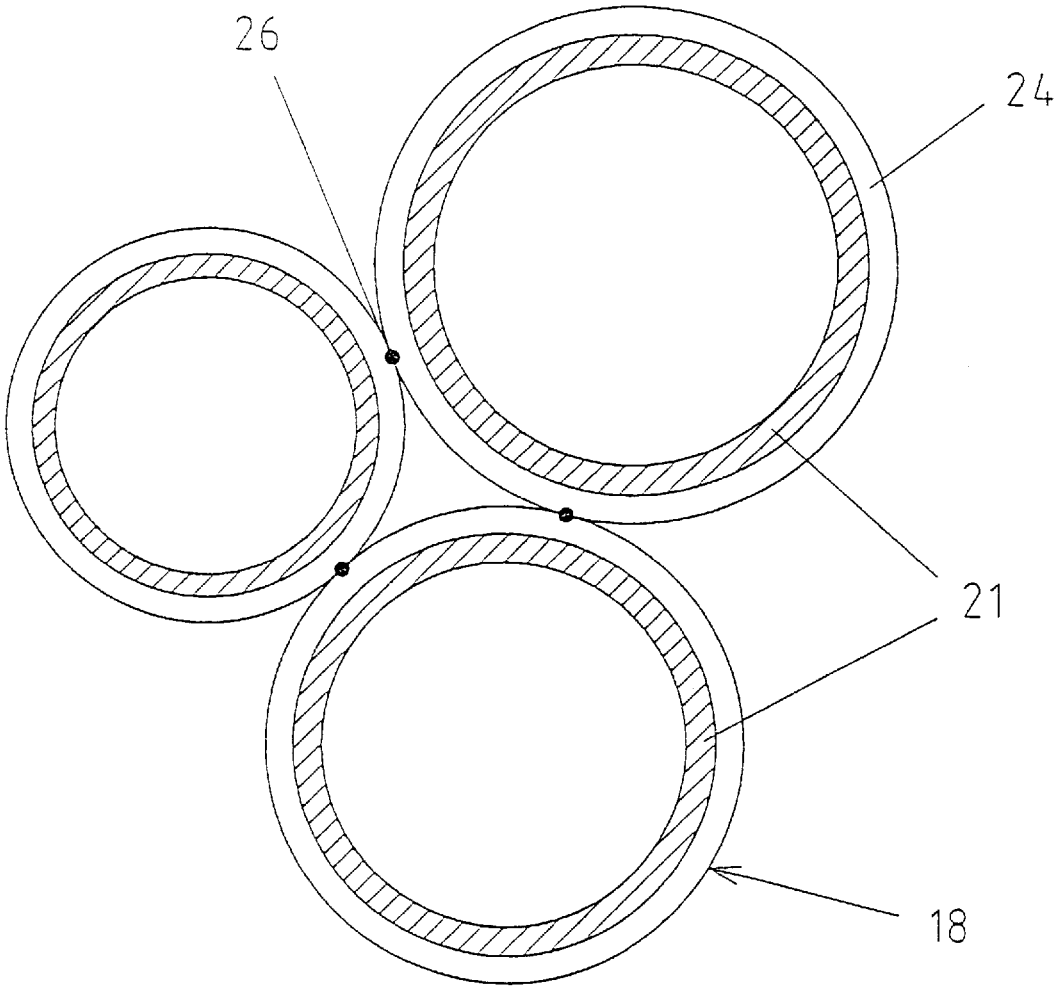
FIG. 9 A section of a hollow sphere filling with coated hollow spheres.

FIG. 9 shows hollow spheres 18 of a hollow sphere fill 25 that are only in contact with one another at points (points 26). This has the result that the portion of heat conduction by way of contact between solid bodies is minimized. Since this is a fill that consists of sphereshaped bodies, they only touch one another at points in a loose fill, while, with other forms of bodies, point contacts occur as well as surface contacts. This means that the total area that has a heat transfer rate is minimized. The heat transfers, solid state gases contribute a great deal less to heat transfer. A further limiting of heat transfer is achieved in that the outer layer 24 of the hollow sphere 18 consists of a material that has a very poor heat conductivity. When hollow sphere semi-finished products 17 are used in which the hollow spheres 18 are connected to one another by sintering contacts, slightly less favorable heat transfer rates are present as compared to the loose hollow sphere fill. However, the hollow sphere semi-finished products 17 have the advantage of easier handling.

What is claimed is:

1. Thermal insulation for insertion between structures, surfaces, walls, or walls of components to be insulated from one another, said thermal insulation comprising:

hollow spheres composed of at least one of silicides, silicide composites, metals, and intermetals and their alloys, ceramics, and glass and said hollow spheres being one of loose or connected to one another by sintered contacts;

said hollow spheres having a wall thickness and an outer diameter which are structured to maintain a ratio of outer diameter to wall thickness within a range of 5–300; and said hollow spheres having an internal pressure within a range of between 0 and 0.1 of the surrounding air pressure at room temperature.

2. The thermal insulation in accordance with claim 1, wherein said hollow spheres are structured with wall having a closed-pored structure.

3. The thermal insulation in accordance with claim 1, wherein the structures, surfaces or walls to be insulated from one another formed by limiting walls of an interior chamber and a housing of a heat treatment furnace.

4. The thermal insulation in accordance with claim 3, wherein an interior wall of said high-treatment furnace is made of a same material as said hollow spheres.

5. The thermal insulation in accordance with claim 1, wherein said hollow spheres are arranged to fill intermediate spaces between radiation shielding plates in a high-temperature furnace and said radiation shielding plates are made of a same material as said hollow spheres.

6. The thermal insulation in accordance with claim 5, wherein said radiation shielding plates are provided with a reflection-changing outer layer and an expansion-adaptive intermediate layer.

7. A The thermal insulation in accordance with claim 6, wherein said intermediate layer has oxygen-diffusion obstruction characteristics.

8. The thermal insulation in accordance with claim 1, wherein said hollow spheres comprise a reflection-altering outer layer and an expansion-adaptive intermediate layer.

9. The thermal insulation in accordance with claim 8, wherein said intermediate layer has oxygen-diffusion obstruction characteristics.

10. The thermal insulation in accordance with claim 1, wherein said silicide composite comprises deposits of at least one of oxides, carbides, borides, and nitrides.

11. The thermal insulation in accordance with claim 1, wherein said hollow spheres are produced with powder metallurgic processes.

12. The thermal insulation in accordance with claim 11, wherein said ceramic hollow spheres are produced by powder ceramic processes including binding and sintering.

13. The thermal insulation in accordance with claim 3, wherein said limiting wall of the insulation inside said furnace is produced by one of powder metallurgic, powder ceramic, casting, and deformation metallurgic processes.

14. The thermal insulation in accordance with claim 5, wherein said limiting wall of the insulation inside said furnace and said radiation shielding plates are produced by one of powder metallurgic, powder ceramic, casting, and deformation metallurgic processes.

15. The thermal insulation in accordance with claim 14, wherein said radiation shielding plates are produced according to a process of film casting and are compressed by debinding and sintering.

16. The thermal insulation in accordance with claim 14, wherein said radiation shielding plates are produced by metal powder injection molding or extrusion and are compressed by debinding and sintering.

17. The thermal insulation according to claim 1, wherein said hollow spheres have a wall thickness of between 10 and 5000 $\mu$m.

18. The thermal insulation according to claim 5, wherein said limiting wall inside said furnace and said radiation shielding plates have a wall thickness of between 10 and 5000 $\mu$m.

19. The thermal insulation according to claim 1, wherein said hollow spheres are provided with a layer of silicide composite between 5 and 1000 $\mu$m thick.

20. The thermal insulation according to claim 19, wherein said silicide composite layer is designed graded.

21. The thermal insulation in accordance with claim 19, wherein said silicide composite layer is provided with an outer layer of high-melting glass.

22. The thermal insulation in accordance with claim 19, wherein said silicide layer is produced by one of slip casting, slip casting, or a spraying process.

23. The thermal insulation according to claim 5, wherein said limiting wall inside said furnace and said radiation shielding plates are provided with a layer of silicide composite between 5 and 1000 $\mu$m thick.

24. The thermal insulation according to claim 23, wherein said silicide composite layer is designed graded.

25. The thermal insulation in accordance with claim 19, wherein said silicide composite layer is provided with an outer layer of high-melting glass.

26. The thermal insulation in accordance with claim 19, wherein said silicide layer is produced by one of slip casting, slip casting, or a spraying process.

27. The thermal insulation in accordance with claim 1, wherein said hollow spheres are connected to one another by sinter contacts, and a plate-like component is produced in a sinter process from said hollow spheres.

28. The thermal insulation in accordance with claim 19, wherein a plate-like component is connected to metal radiations shields one of during and after production in a separate production step.

* * * * *

UNITED STATES PATENT AND TRADEMARK OFFICE

CERTIFICATE OF CORRECTION

PATENT NO. : 6,501,784 B1
DATED : December 31, 2002
INVENTOR(S) : A. Boehm et al.

It is certified that error appears in the above-identified patent and that said Letters Patent is hereby corrected as shown below:

Title page,
Item [73], Assignees, "Fraunhofer-Gesellschaft zur Förderung der Angewandten Forschung e.V., Müchen (DE); Nabertherm GmbH & Co. Industrieofenbau KG, Lilienthal/Bremen (DE)" should be -- Fraunhofer-Gesellschaft zur Förderung der Angewandten Forschung e.V., München (DE) --.

Signed and Sealed this

Seventeenth Day of June, 2003

JAMES E. ROGAN
*Director of the United States Patent and Trademark Office*